US005299804A

United States Patent [19]

Stevens

[11] Patent Number: 5,299,804

[45] Date of Patent: Apr. 5, 1994

[54] FOLDING PUZZLE USING TRIANGULAR BLOCKS

[76] Inventor: Kenneth V. Stevens, 728 Carroll St., Brooklyn, N.Y. 11215

[21] Appl. No.: 6,672

[22] Filed: Jan. 19, 1993

Related U.S. Application Data

[63] Continuation of Ser. No. 801,272, Dec. 2, 1991, abandoned.

[51] Int. Cl.[5] ..... A63F 9/08

[52] U.S. Cl. ..... 273/155; 446/487

[58] Field of Search ..... 273/153 P, 155, 157 R; 446/487

[56] References Cited

U.S. PATENT DOCUMENTS

| | | | |
|---|---|---|---|
| 239,879 | 4/1881 | Stranders | 273/155 |
| 510,216 | 12/1893 | Waibel | 273/155 |
| 1,547,967 | 7/1925 | Shilhan | 273/155 |
| 2,883,195 | 4/1959 | Rogers et al. | 273/155 |
| 3,518,785 | 7/1970 | Behr | 273/155 |
| 3,596,396 | 8/1971 | Thomson | 446/487 |
| 3,866,748 | 2/1975 | Manning, Jr. | 273/155 |
| 3,962,816 | 6/1976 | Sarid | 273/155 |
| 4,307,886 | 12/1981 | Kemper | 273/157 R |
| 4,392,323 | 7/1983 | Rubik | 446/487 |
| 4,633,607 | 1/1987 | Brasch et al. | 446/487 |
| 4,722,712 | 2/1988 | McKenna | 273/155 |
| 4,875,681 | 10/1989 | Ofir | 273/155 |

FOREIGN PATENT DOCUMENTS

| | | | |
|---|---|---|---|
| 2107200 | 4/1983 | United Kingdom | 273/155 |

OTHER PUBLICATIONS

Gardner, Martin, Scientific American, "Flexagons", Dec. 1956, pp. 162–166.

Gardner, Martin, Scientific American, "Mathematical Games", May 1971, pp. 110–116.

*Primary Examiner*—Vincent Millin

*Assistant Examiner*—Steven B. Wong

*Attorney, Agent, or Firm*—Ostrager, Chong & Flaherty

[57] ABSTRACT

A folding puzzle is made of 4N identical block elements of three-dimensional right triangular form. The two right-angle sides of each block element are connected by hinge elements to the correspondingly matching right-angle sides of preceeding and succeeding block elements, such that the block elements are connected in a series. The hinge elements provide folding lines at one side of the block elements to allow adjacent block elements to be folded overlying each other. The series of block elements may be connected in a closed loop, with a continuous tape layer applied over the inner plane surfaces of the block elements for structural stability. The hinge elements may be flexible tape elements, leaf or extruded tab-type hinges, or detachable hinges which allow a closed loop to be opened or to be joined with other series of block elements. Visual indicia, such as letters, numbers, or images, may be applied to the plane surfaces of the block elements so that they can be matched to paired block elements or mixed-and-matched with other block elements.

14 Claims, 11 Drawing Sheets

FIG. 4K
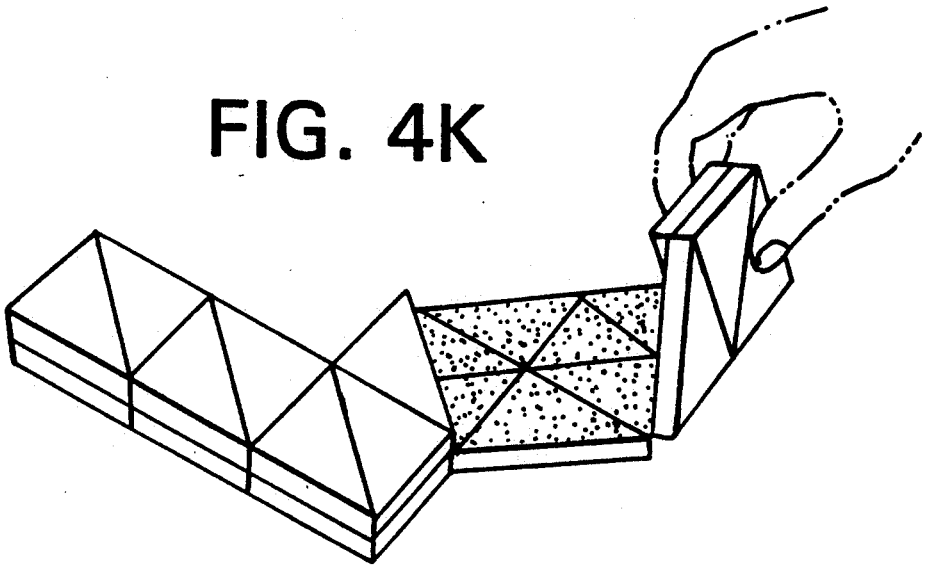
FIG. 4L
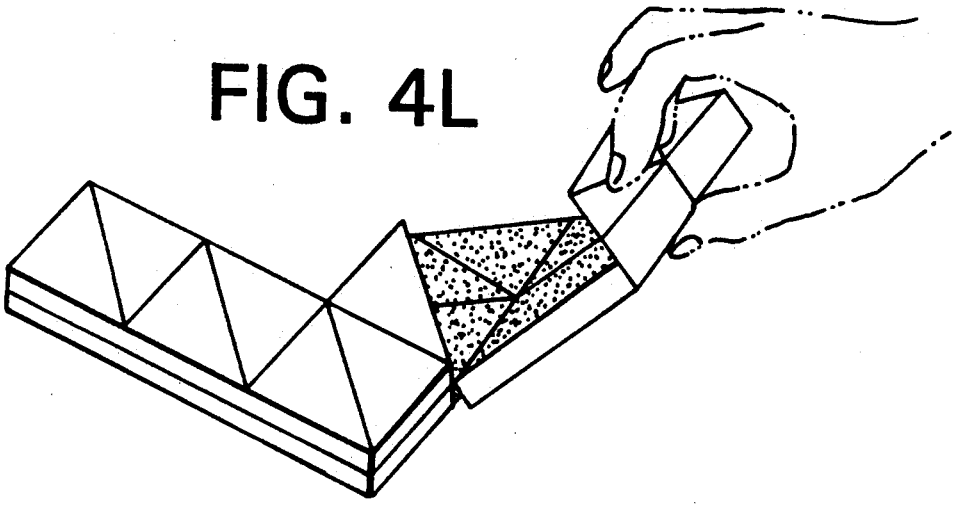
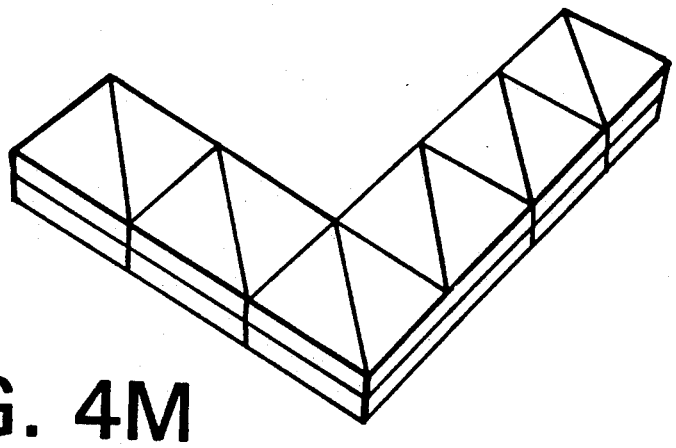
FIG. 4M

FOLDING PUZZLE USING TRIANGULAR BLOCKS

This patent application is a continuation application of U.S. patent application Ser. No. 07/801,272, filed on Dec. 2, 1991, now abandoned.

FIELD OF THE INVENTION

This invention generally relates to a a folding puzzle, and particularly to one using a series of triangular blocks to form different puzzle block shapes.

BACKGROUND ART

Stacking blocks has long been a favorite game for young children, and it is also an educational tool for training eye-hand coordination and teaching them about shapes and dimensions. Puzzles can teach children more advanced skills of conceptualizing and problem solving. Games have also been offered which combine manipulation and conceptualizing skills, such as interlocking puzzles or folding puzzles such as origami (Japanese paper folding).

SUMMARY OF THE INVENTION

The present invention is directed to a new folding puzzle for younger children which has a relatively simple construction of connected blocks, yet can be folded in many different ways so as to produce surprising shapes and interesting visual combinations.

In accordance with the invention, a folding puzzle comprises a plurality of substantially identical block elements, each of said block elements being in three-dimensional right triangular form defined by two right-angle sides, a hypotenuse side, and first and second triangular plane surfaces separated by a given thickness, wherein each of the two right-angle sides of each block element is connected by a hinge element to a correspondingly matching right-angle side of a preceeding and a succeeding block element, such that said plurality of block elements are connected together in a series, and said hinge elements are arranged and positioned so as to allow any two hinged adjacent block elements to be unfolded coplanar with each other and folded together so that one block element overlies the other.

In the preferred embodiments, the number of block elements is 4N, wherein N is a positive integer. The hinge elements may be flexible tape elements made of plastic or fabric. A single, continuous tape layer may also be applied over the plane surfaces on one side of all the block elements for structural stability. The hinge elements may alternatively be made of leaf-type hinges of plastic or metal, or extruded plastic tabs which have side edges or beads that are retained in grooves formed in the corresponding edges of the block elements.

The block elements fold in different combinations together in patterns of squares or rectangles that interlock or fit together to form interesting combination shapes, images, or three-dimensional mazes. Puzzle versions having 8 and 12 block elements are found to be particularly suitable for play by younger children, and 16-, 20-, and 24-element versions are found to provide more advanced levels of play. The block elements may be connected together in a loop, or in a line with detachable hinge elements at the ends for joining in a loop or connecting with other series of block elements. A particularly attractive version of the folding puzzle of the invention has visual indicia applied to the plane surfaces on the same side and/or on reverse sides of the block elements which can be mixed or matched with other block elements. The visual indicia may be applied to panels which can be removably attached to the plane surfaces of the block elements as a further play option.

Other objects, features and advantages of the present invention will be apparent from the following detailed description of the preferred embodiments with reference to the drawings, of which:

BRIEF DESCRIPTION OF THE DRAWINGS

FIGS. 4A–4M shows a series of folding sequences transforming a 24-element version from one shape into another folded shape.

DETAILED DESCRIPTION OF THE INVENTION

In the present invention, a folding puzzle is formed by a connected series of substantially identical right triangular block elements. When the number of block elements is selected to be 4N, where N is a positive integer, the puzzle can be folded into shapes based upon combining pairs of block elements into squares or rectangles. Visual indicia can be applied to the front and back faces of the block elements to allow mixing and matching of visual indicia in visually interesting paired combinations, images, or mazes.

Figure 1A:
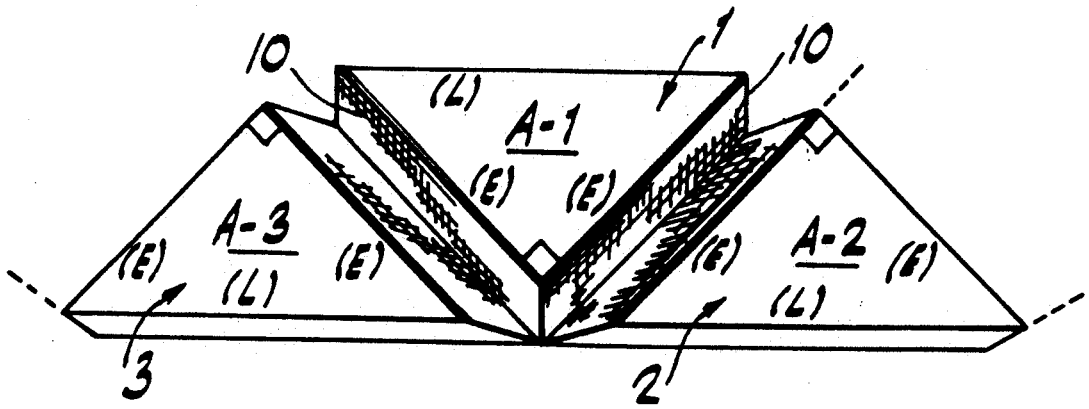
FIG. 1A shows a first side of planar surfaces of a triangular block element connected by hinge elements to preceeding and succeeding block elements in accordance with-the invention.
Figure 1B:
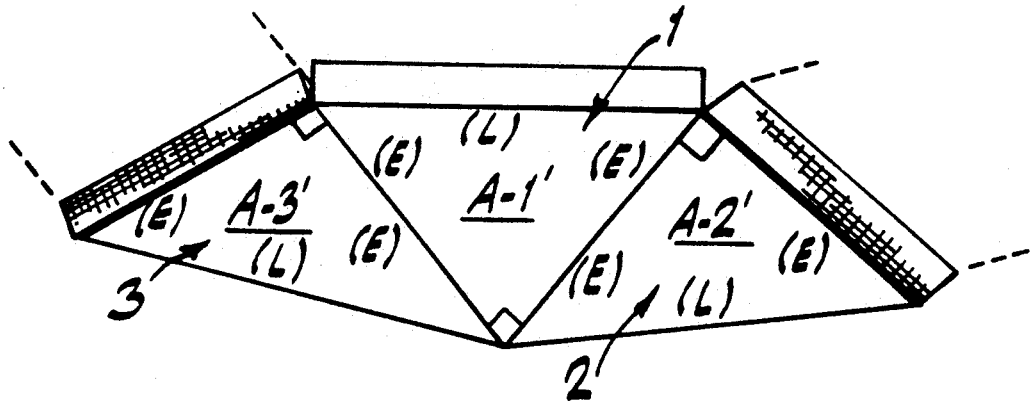
FIG. 1B shows a second (reverse) side, of planar surfaces of the triangular block elements of FIG. 1A.
Figure 1C:
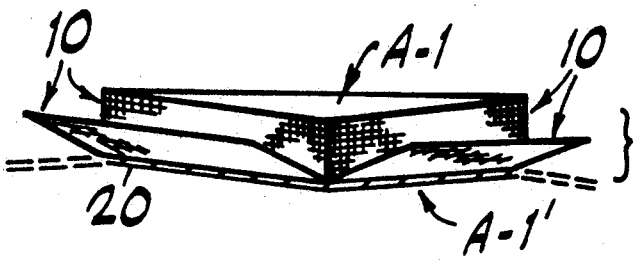
FIG. 1C shows a profile view of the hinge elements of each block element.

As shown in FIGS. 1A, 1B, and 1C, each of the block elements is a three-dimensional right triangular block. In this example, the block elements are right isoceles triangles having equal right-angle sides (E), a hypotenuse side (L), and first and second triangular plane surfaces separated by a given thickness T. However, the block elements may be any right triangular form, e.g., one in which the sides are proportioned according to the Golden Section, which is defined as the proportions of two segments and their total length such that the ratio of the total length to the longer segment is the same as the ratio of the longer segment to the shorter segment. Using matched reference numerals, the block element 1 has a first (front) plane surface A-1 and a second (rear) plane surface A-1' (shaded in the drawings). Block element 2 correspondingly has plane surfaces A-2 and A-2', and block element 3 has plane surfaces A-3 and A-3'. The two right-angle sides (E) of the block element 1 is connected by respective hinge elements 10 to the correspondingly matched right-angle sides (E) of the preceeding block element A-2 and the succeeding block element A-3.

Figure 1D:
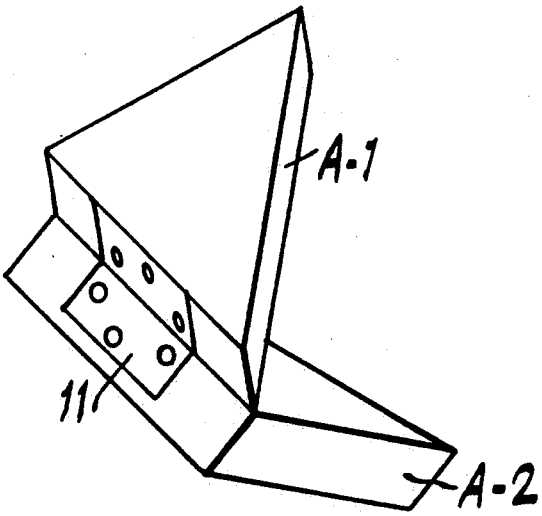
FIG. 1D shows block elements with a leaf-type hinge.
Figure 1E:
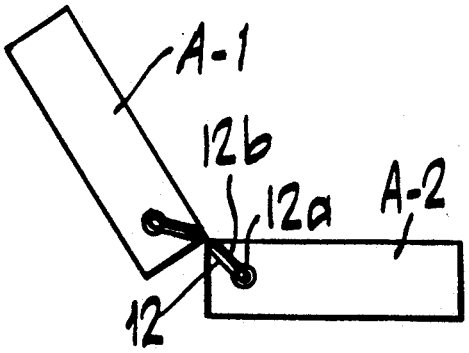
FIG. 1E shows block elements with a tab-type hinge.
Figure 1F:
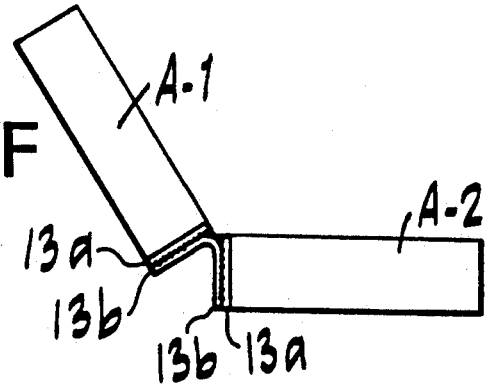
FIG. 1F shows block elements with a detachable hinge.
Figure 2A:
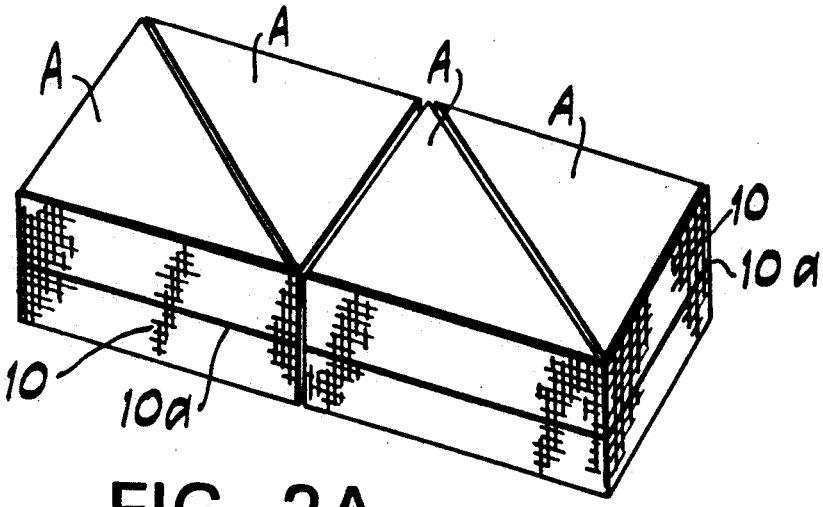
FIGS. 2A–2D show an 8-element version of the folding puzzle of the present invention, and one folding sequence for the same.
Figure 2B:
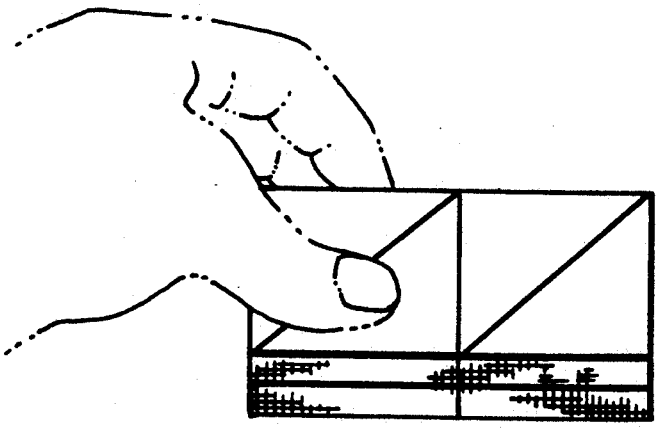
Figure 2C:
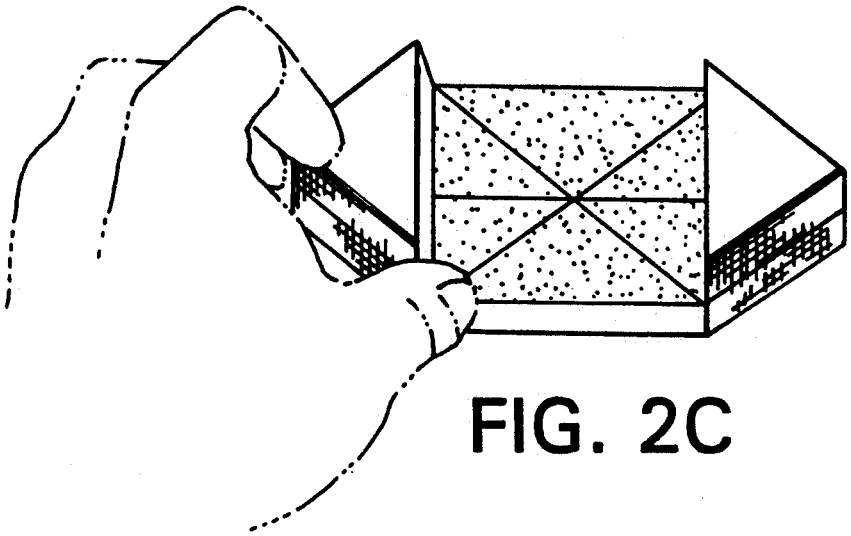
Figure 2D:
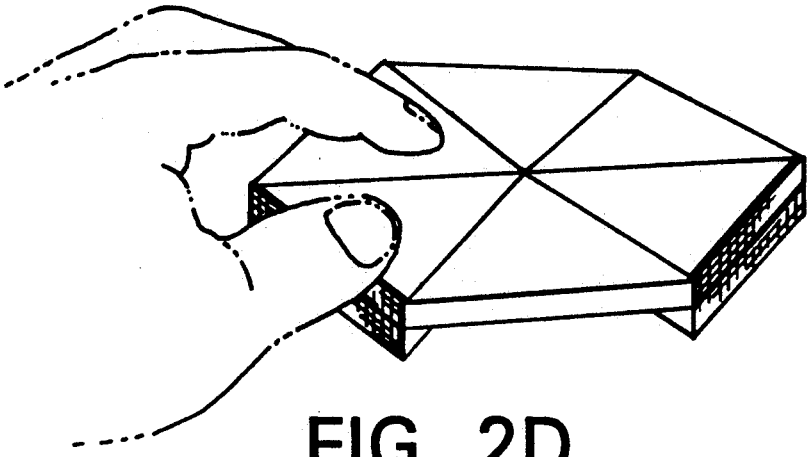

In FIG. 1C, the hinge elements 10 are shown arranged and positioned so that respective hinged folding lines are formed opposite from one (the first) plane surface A-1 and adjacent the other (second) plane surface A-1'. This allows adjacent block elements to be folded to overlie adjacent block elements with their second plane surfaces in contact together. The hinge elements 10 are preferably in the form of flexible tape elements which are made of plastic or fabric and have an adhesive layer for fastening onto the sides of the block elements. In addition, a single, continuous tape layer 20 is applied over all of the second plane surfaces of the block elements in order to provide structural stability to the hinges and to the folding lines and surfaces of the block elements. In FIGS. 1D and 1E, the hinge elements are alternatively made of leaf-type hinges 11 of plastic or metal which are secured to the sides of the block elements with nails, rivets, or adhesive, or extruded plastic tabs 12 which have side edges or beads 12*a* that are retained in grooves 12*b* formed in the corresponding edges of the block elements. In FIG. 1F, the hinge elements are made of detachable fastener portions 13*a*, 13*b*, such as the hook and loop portions of a Velcro TM fastener.

In FIGS. 2A–2D, an 8-element version of the folding puzzle is shown folded in a quadrilateral configuration of two tiers of triangular block elements A paired together in squares or rectangles. The first plane surfaces of the block elements A are indicated without shading, whereas the second plane surfaces are indicated by zig-zag shading. The hinge elements 10 are indicated by cross-hatched shading, and the hinge folding lines 10*a* are indicated as heavy lines. The unfolding sequence in FIGS. 2B–2D opens the quadrilateral shape and exposes the second plane surfaces (shaded) of the lower tier of block elements. The 8-element folding puzzle version is found to be particularly suitable for play by younger children, since it is confined to relatively simple folding sequences which result in exposure of the different faces of the block elements.

Figure 3:
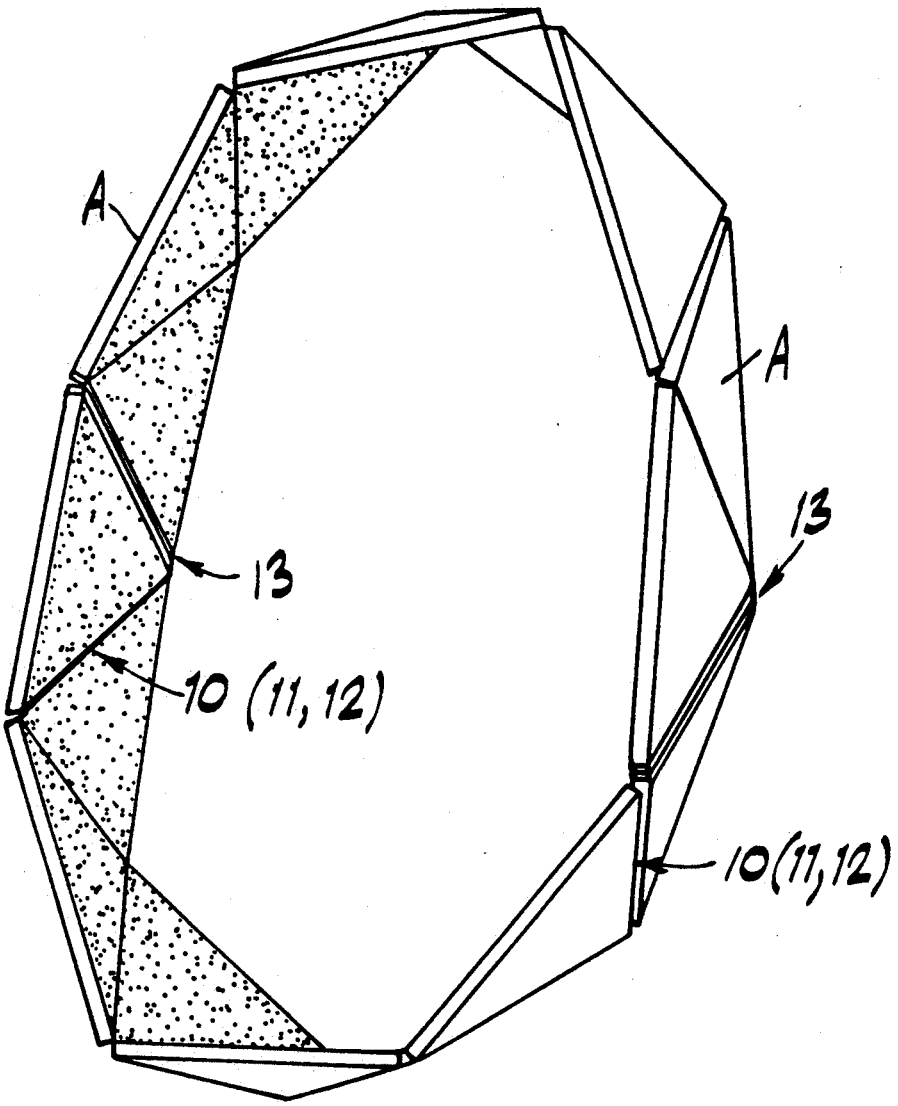
FIG. 3 shows a 16-element version of the folding puzzle of the present invention connected in a loop.
Figure 4A:
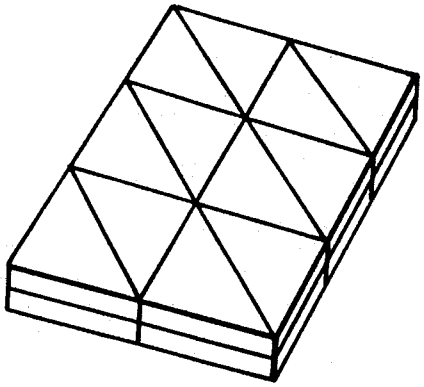
Figure 4B:
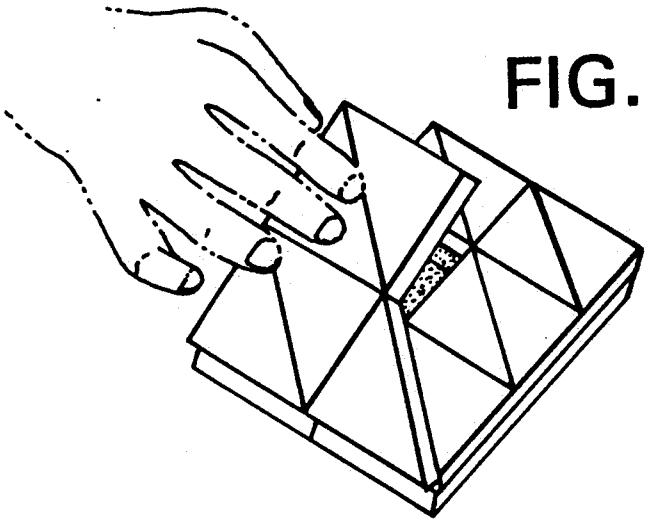
Figure 4C:
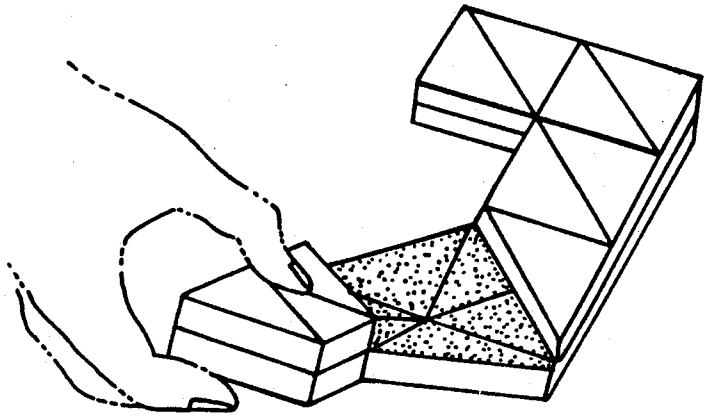
Figure 4D:
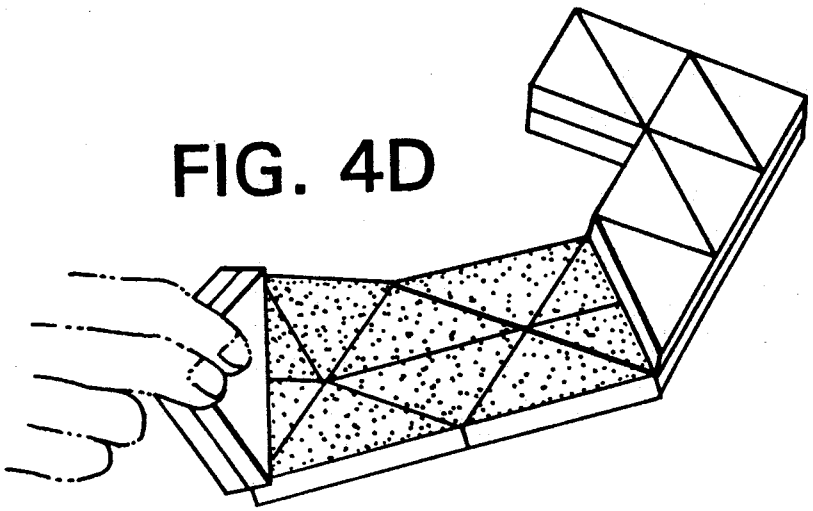
Figure 4E:
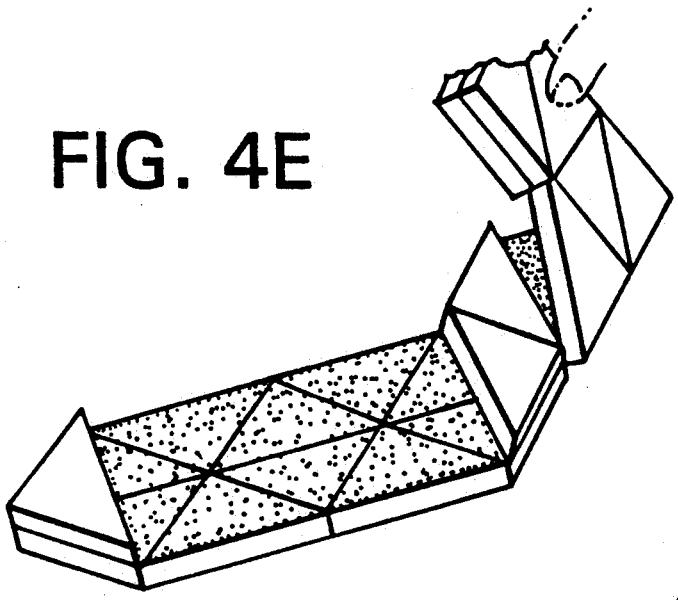
Figure 4F:
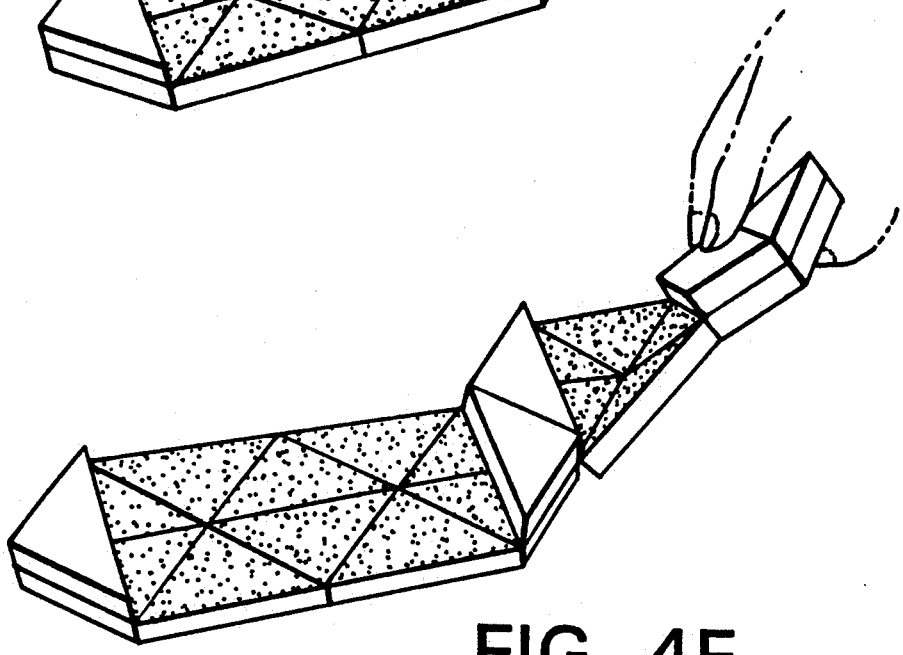
Figure 4G:
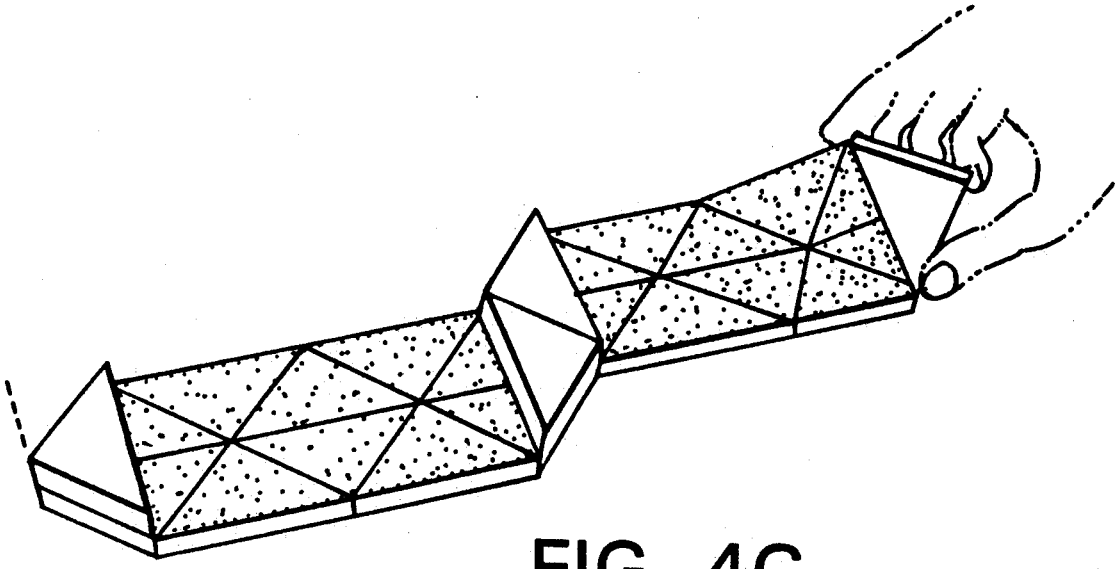
Figure 4H:
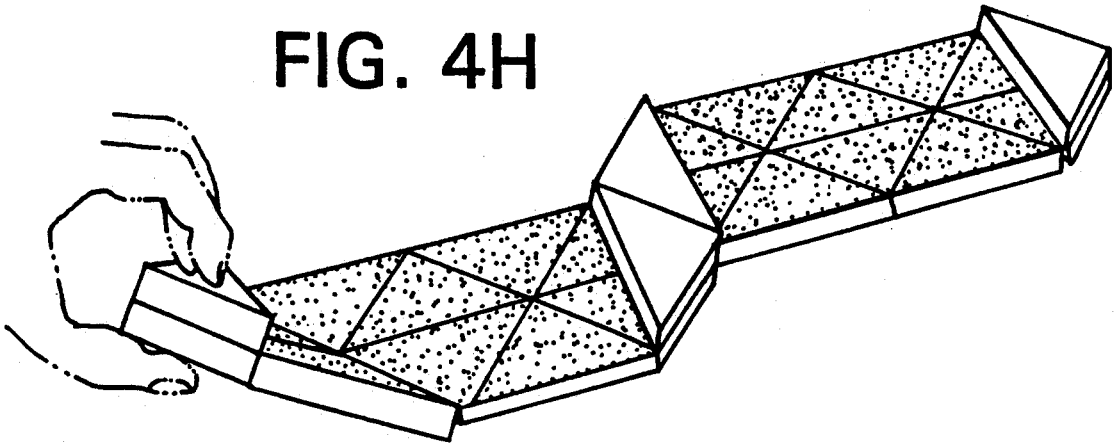
Figure 4I:
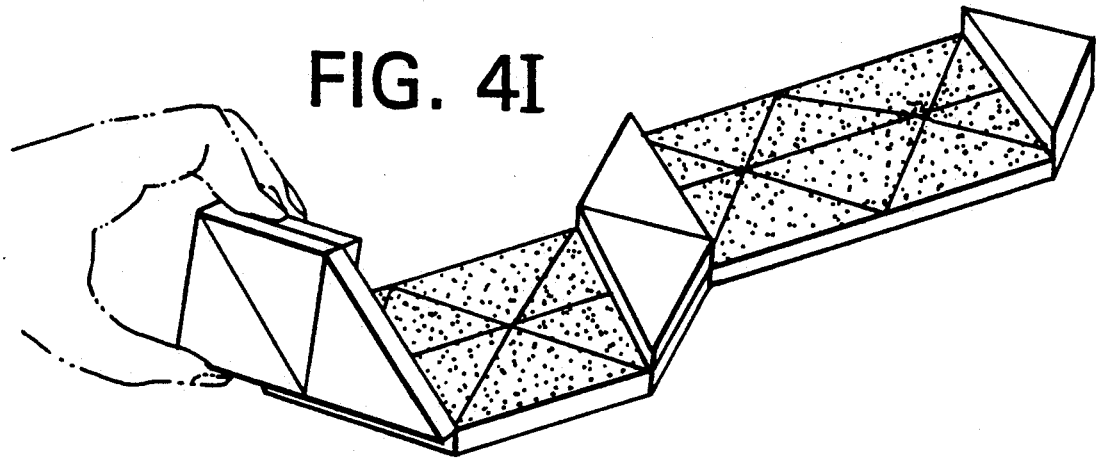
Figure 4J:
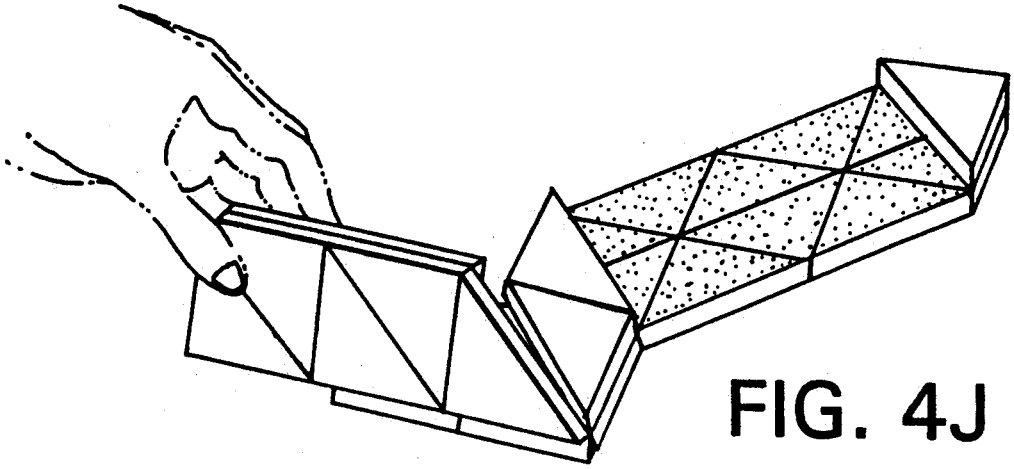

In FIG. 3, a 16-element version of the folding puzzle is shown in a fully opened state demonstrating the preferred form in which the block elements are connected in a series forming a closed loop. The second plane surfaces of the block elements (shaded) form a continuous inner surface and the first plane surfaces (unshaded) form a continuous outer surface. The heavy lines 13 illustrate that a long (here, 16-element) series can be formed by two or more shorter (8-element) series of block elements using the detachable Velcro TM hinge elements 13.

Figure 5:
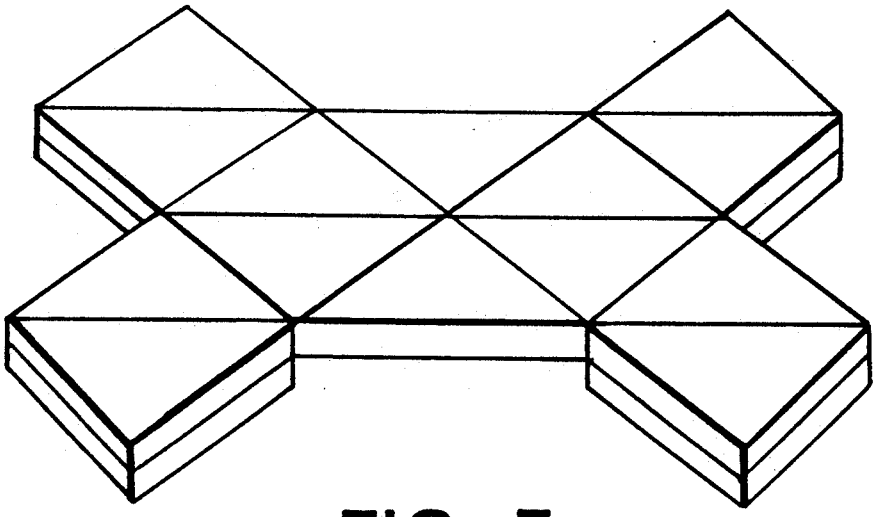
FIG. 5 shows another example of a folded shape for the 24-element version of FIG. 4.
Figure 6:
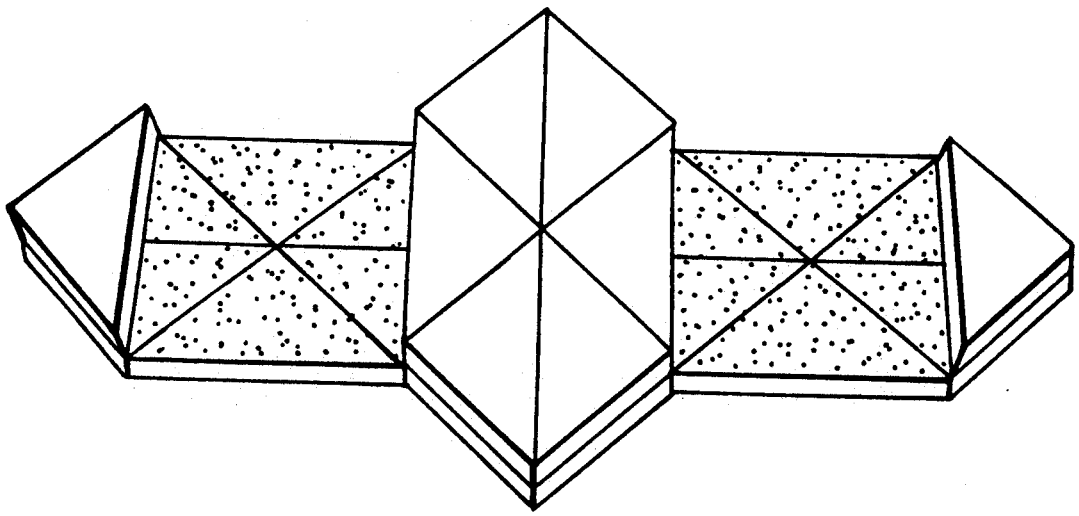
FIG. 6 shows a further example of a folded shape for the 24-element version of FIG. 4.

In FIGS. 4A–4M, a 24-element version is shown undergoing a folding sequence which transforms it from an initial quadrilateral two-tiered shape, to a linear shape, and finally to a right-angle two-tiered shape. FIGS. 5 and 6 show other examples of folded shapes for the 24-element version. The 24-element version is found to provide a more advanced level of play based upon combining pairs of triangular block elements in pairs of squares or rectangles. A 24-element version is a preferred upper number of block elements, as too great a number becomes unwieldy and less structurally stable. However, a greater number of block elements may be used, for example, 32 or 36 elements and higher for more challenging versions.

When the series of connected block elements is constrained in the form of a closed loop, only certain folding combinations and sequences will result in symmetric or desirable shapes. Thus, the player is challenged to conceptualize the particular folding sequence that will yield a desired shape. For easier play, the series may have a detachable hinge element to open the block elements in a line, wherein the folding combinations and sequences are less constrained, and the block elements can be used to form shapes at will. Two or more block series may be used to interlock together in compound constructions. The block elements may also be folded on edge (90 degrees) to form three-dimensional constructions, such as arches or mazes.

Figure 7A:
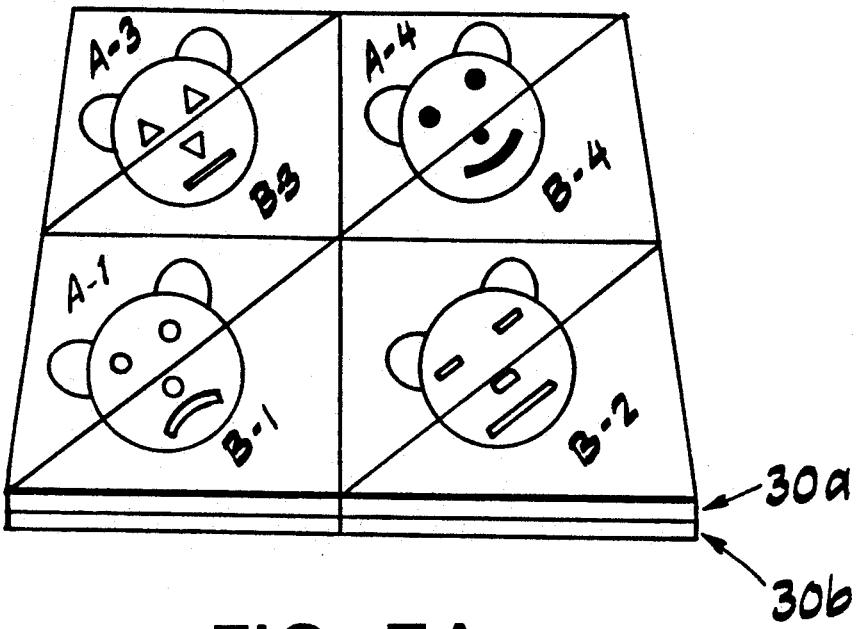
FIGS. 7A–7D shows a folding sequence for the 16-element version having matched pairs of visual indicia applied to their faces, and an example of mixing-and-matching of the visual indicia.
Figure 7B:
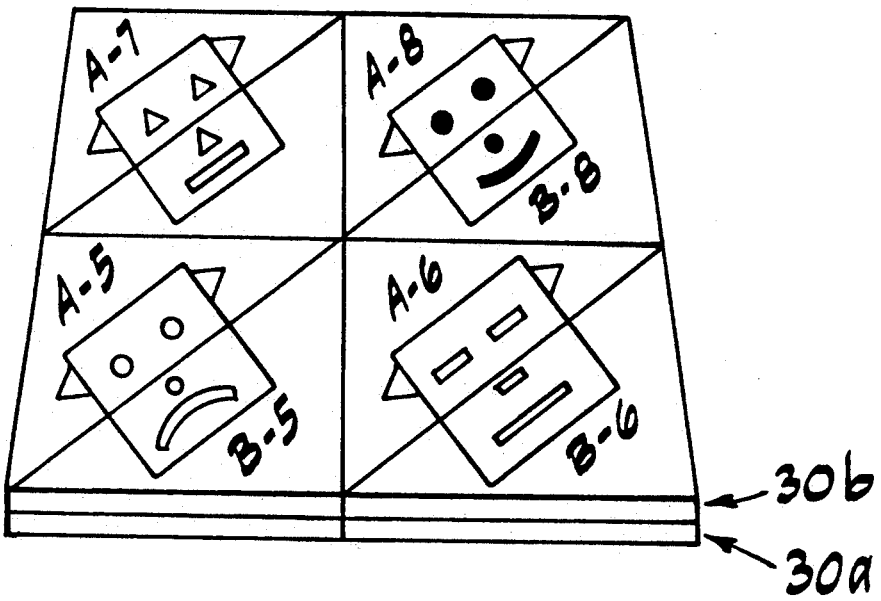
Figure 7C:
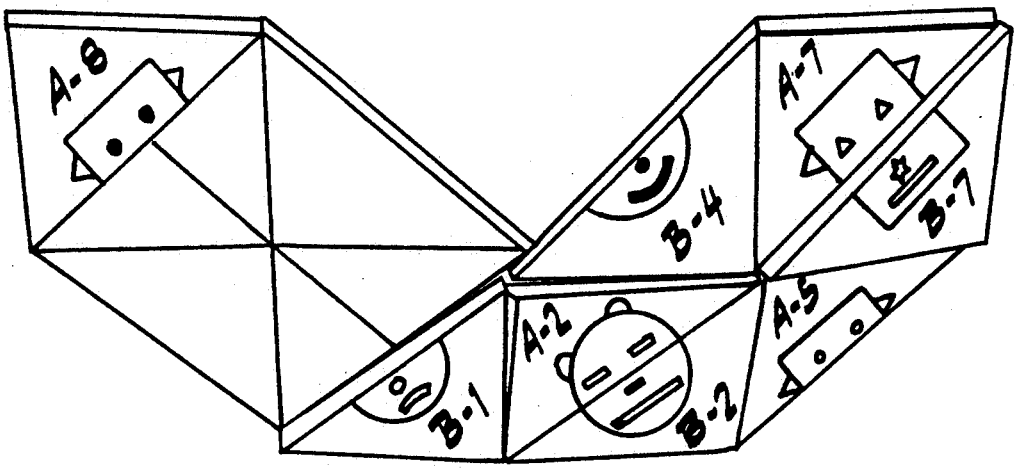
Figure 7D:
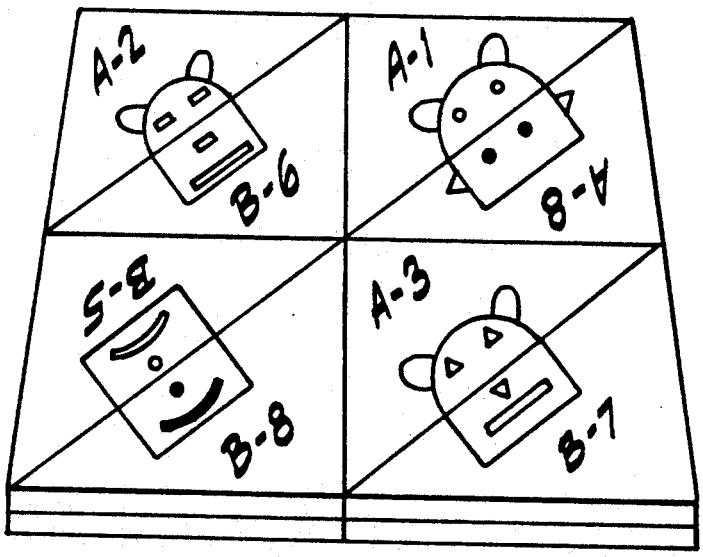

In FIG. 7A and 7B, the folding puzzle is shown having matched pairs A-i, B-j of visual indicia applied to the plane surfaces on one side of block elements. The 16-element version is shown folded into two tiers 30*a*, 30*b* of block elements with four squares or rectangles of paired block elements in each. The visual indicia in the original configuration might, for example, consists of paired upper and lower halves forming a complete face in each square, with different faces in the different squares. When the block elements are unfolded and refolded in different sequences, different upper halves are mixed and matched with other lower halves to form new combinations of faces. The visual indicia might also be in the form of alphabets or numbers for use as a teaching tool. The visual indicia may also be applied to the reverse side of the block elements, for added visual combinations and effects. The visual indicia may also be in the form of flat triangular panels which can be detachably mounted to the faces of the block elements, for example, by the use of retainer or recessed edges formed on the faces of the block elements.

Although the invention has been described with reference to certain preferred embodiments, it will be appreciated that many variations and modifications may be made consistent with the broad principles of the invention. It is intended that the preferred embodiments and all of such variations and modifications be included within the scope and spirit of the invention, as defined in the following claims.

I claim:

1. A folding puzzle comprising a plurality of substantially identical triangular block elements, each of said block elements being in three-dimensional right triangular form defined by first and second right-angle legs and a third hypotenuse leg defining each of its opposing first and second triangular plane surfaces separated by a given uniform block thickness, wherein each first right-angle leg at one of said plane surfaces of each block element is connected by a hinge element to a correspondingly matching first right-angle leg at a same one of said plane surfaces of a preceeding adjacent block element, and each second right-angle leg at said one plane surface of each said block element is connected by a hinge element to a correspondingly matching second right-angle leg at the same said plane surface of a succeeding adjacent block element, such that said plurality of block elements are connected together in a series oriented in alternating right-angle-leg directions with all of the hinge elements positioned at a same one of said triangular plane surfaces of the block elements and all of said one triangular plane surfaces and hinge elements of the block elements defining a substantially continuously connected loop surface for said series of block elements, and said hinge elements are arranged and positioned so as to allow any two hinged adjacent block elements to be unfolded coplanar with each other and folded together so that one block element overlies the other, wherein said arrangement of said series of block elements all hinged on the same plane surface side thereof forming a continuously connected loop surface allows said blocks to be manipulated as a folding puzzle for forming different quadrangular polyomino shapes.

2. A folding puzzle according to claim 1, wherein the number of block elements is 4N, N being a positive integer.

3. A folding puzzle according to claim 1, wherein said hinge elements are flexible tape elements.

4. A folding puzzle according to claim 1, wherein the plane surfaces on said one side of said block elements define an inner loop surface of a closed loop formed by said series of block elements, and a single, continuous tape layer is applied over the inner loop surface connecting said block elements for structural stability.

5. A folding puzzle according to claim 1, wherein said hinge elements are leaf-type hinges.

6. A folding puzzle according to claim 1, wherein said hinge elements are flexible plastic tabs which have beads that are retained in grooves formed in corresponding edges of said block elements.

7. A folding puzzle according to claim 1, wherein at least one of said hinge elements is formed with detachable portions that allow the series of block elements to be detachably separated thereat.

8. A folding puzzle according to claim 7, wherein said sereis of block elements is composed at least two subseries of lesser numbers of block elements joined together by detachable hinge elements.

9. A folding puzzle according to claim 1, wherein visual indicia are applied to the plane surfaces of said block elements.

10. A folding puzzle according to claim 9, wherein said visual indicia are applied to paired combinations of block elements such that they can be matched to each other and mixed-and-matched with other block elements.

11. A folding puzzle according to claim 9, wherein said visual indicia are applied to respective display panels which are detachably mounted to the plane surfaces of said block elements.

12. A folding puzzle according to claim 9, wherein said visual indicia are applied to the plane surfaces on one side of said block elements.

13. A folding puzzle according to claim 9, wherein said visual indicia are applied to the plane surfaces on both sides of said block elements.

14. A folding puzzle according to claim 1, further comprising at least a second series of block elements assembled in combination with the first-mentioned series of block elements.

* * * * *